US008770067B2

(12) United States Patent
Qiu

(10) Patent No.: US 8,770,067 B2
(45) Date of Patent: Jul. 8, 2014

(54) PLIERS WITH ADJUSTABLE JAW SPAN

(75) Inventor: Jianping Qiu, Hangzhou (CN)

(73) Assignees: Hangzhou Great Star Industrial Co., Ltd., Hangzhou, Zhejiang Province (CN); Hangzhou Great Star Tools Co., Ltd., Hangzhou, Zhejiang Province (CN)

( * ) Notice: Subject to any disclaimer, the term of this patent is extended or adjusted under 35 U.S.C. 154(b) by 268 days.

(21) Appl. No.: 13/384,205

(22) PCT Filed: Jul. 16, 2010

(86) PCT No.: PCT/CN2010/075222

§ 371 (c)(1),
(2), (4) Date: Jan. 13, 2012

(87) PCT Pub. No.: WO2011/006452

PCT Pub. Date: Jan. 20, 2011

(65) Prior Publication Data

US 2012/0111157 A1 May 10, 2012

(30) Foreign Application Priority Data

Jul. 16, 2009 (CN) ..... 2009 2 0125147 U

(51) Int. Cl.
*B25B 7/10* (2006.01)

(52) U.S. Cl.
CPC ..... *B25B 7/10* (2013.01)
USPC ..... 81/409.5; 81/416; 81/391

(58) Field of Classification Search
USPC ..... 81/409, 409.5, 411, 416, 391–394
See application file for complete search history.

(56) References Cited

U.S. PATENT DOCUMENTS 1,565,210 A * 12/1925 Seiber ..... 81/409.5
3,534,641 A * 10/1970 Duc ..... 81/357

(Continued)

FOREIGN PATENT DOCUMENTS

CN 1669741 A 9/2005
CN 101190513 A 6/2008
EP 1574292 A1 9/2005

OTHER PUBLICATIONS

International Search Report for PCT/CN2010/075222, Jan. 20, 2011, 5 pages.

(Continued)

*Primary Examiner* — David B Thomas
(74) *Attorney, Agent, or Firm* — Marger Johnson & McCollom PC

(57) ABSTRACT

Pliers with adjustable jaw span have a first member (1) and a second member (2) which cooperate with each other. A long slot (13) is formed in the first member (1). The second member (2) is connected with the first member (1) by means of a pivot (3) passing through the long slot (13), and rotatable around the pivot (3) relative to the first member (1), while adjusting the span of the jaws by varying the position of the pivot (3) within the long slot (13). The edge of the long slot (13) is provided with ratchet teeth (14). The pivot (3) is engaged with the ratchet teeth (14) by a pawl (31), thus the pivot is movable within the long slot (13) in a first direction and immovable in a second direction which is opposite to the first direction. The pliers are convenient to operate because when the position of the pivot (3) is moved within the long slot (13), the user's operation is required only for the movement in one direction.

15 Claims, 5 Drawing Sheets

(56) References Cited

U.S. PATENT DOCUMENTS

| | | | | |
|---|---|---|---|---|
| 4,048,878 | A * | 9/1977 | Nystrom | 81/409 |
| 4,269,089 | A * | 5/1981 | Hastings | 81/409.5 |
| 4,438,669 | A * | 3/1984 | Hastings et al. | 81/409.5 |
| 4,773,288 | A | 9/1988 | Jang et al. | |
| 4,802,390 | A * | 2/1989 | Warheit | 81/341 |
| 5,020,399 | A * | 6/1991 | Annis et al. | 81/358 |
| 5,060,543 | A * | 10/1991 | Warheit | 81/409 |
| 5,845,551 | A * | 12/1998 | Putsch | 81/412 |
| 6,502,482 | B1 * | 1/2003 | Putsch et al. | 81/405 |
| 6,880,434 | B2 * | 4/2005 | Nouvel | 81/409 |
| 6,892,609 | B2 * | 5/2005 | Kuo | 81/413 |
| 7,222,558 | B2 * | 5/2007 | Schmitt et al. | 81/411 |
| 7,255,027 | B1 | 8/2007 | Tsai | |
| 7,748,300 | B2 * | 7/2010 | Picaza Ibarrondo | 81/409.5 |
| 2010/0018364 | A1 * | 1/2010 | Chervenak et al. | 81/413 |
| 2010/0064861 | A1 * | 3/2010 | Herrmann | 81/409 |

OTHER PUBLICATIONS

International Search Report, Patent Cooperation Treaty, Jan. 20, 2011, 5 pages, PCT/CN2010/075222, The State Intellectual Property Office, Beijing, China.

Written Opinion of the International Searching Authority, Patent Cooperation Treaty, Oct. 28, 2010, 4 pages, PCT/CN2010/075222, The State Intellectual Property Office, Beijing, China.

* cited by examiner

PLIERS WITH ADJUSTABLE JAW SPAN

TECHNICAL FIELD OF THE INVENTION

The invention relates to hardware tools, and specifically to pliers, whose jaw span can be adjusted fast, such as water pump pliers.

BACKGROUND OF THE INVENTION

Conventional pliers (such as wire pliers) are formed in such a way that a pivot connects two members which include a jaw and a handle, respectively. In use, the jaw span (the space between two jaws for clamping objects) is adjustable only by operating the handles to rotate around the pivot, and the applicable range of the jaws is small. However, some types of pliers require the span adjustment of the jaws in use. For example, water pump pliers require the span adjustment of the jaws in accordance with the size of the pipe to be clamped.

To this end, pliers appear with a larger adjustable jaw span. Such technical scheme is also repeatedly recorded in patent documents, such as the Chinese Utility Model Patent being representative, entitled "Fast Locking Water Pump Pliers", with the Authorized Publication Number being CN2790679Y and the Patent Number being ZL200520070493.2. The disclosed water pump pliers include a left member 101 and a right member 102, as shown in FIG. 16 and FIG. 17. The left member 101 is provided with a bar-shaped hole 113 in an open way. Both sides of the bar-shaped hole are provided with a rack 114. The right member 102 is provided with a hinged hole 123 in an open way. A hollow bolt 103 tightly fits a blind nut 104 through the bar-shaped hole 113 and the hinged holes 123. The hollow bolt 103 is axially provided with a hole 131 in the central part in an open way with a sliding part 105 arranged therein, and a gear 151 is arranged at the inner end of the sliding part. One end of a spring 106 is installed on the blind nut 104, while the other end is installed on the sliding part 105, so as to bias the sliding part in the predetermined working position. In the position, the gear 151 is engaged with the rack 114 of the left member 101, so that the hollow bolt 103 cannot slide within the bar-shaped holes 113 of the left jaw. The jaws will be opened and closed when the left and right members 101, 102 are operated at this time so as to clamp and twist objects. Now, under the effect of the bias force of the spring 106, the sliding part 105 is in an ejected state, and the button 107 at the external end thereof extends beyond the hollow bolt 103.

If the span of the jaws needs to be adjusted, the button 107 is pressed only, so that the sliding part 105 overcomes the bias force of the spring 106 to slide inwardly, and the gear 151 at the inner end of the sliding part 105 is disengaged from the rack 114. Now, the right member 102 can randomly slide in the bar-shaped holes 113 of the left member 101 along with the hollow bolt 103. When it is adjusted to the required position, the button 107 is released again. The sliding part 105 resets under the effect of the bias force of the spring 106. The gear 151 is re-engaged with the rack 114. The left and right members 101, 102 are repositioned, and the water pump pliers can be in normal use again.

In the configuration, no matter whether the jaw span is adjusted to be larger or to be smaller, the button needs to be pressed so that the gear is disengaged from the rack, which is inconvenient in operation. Specifically, the size of the object to be clamped cannot be estimated very accurately when being clamped and since the force can be best applied to the object to be clamped and it is most convenient and comfortable to use for hands only when the jaws is in the parallel position, it requires repeated adjustment in the actual use. In particular when working in some small or narrow spaces, It is possible that we cannot see the object to be clamped with our eyes, so we can only determine the best jaw span by making continuous attempts. And the pliers with the above configuration can be adjusted only after being pressed by hands. In many positions, hands cannot reach into the position proximate to the object, which makes it more troublesome. Thus we need to take the pliers out for adjustment and then put it in for another try. If it is not suitable, we should take it out again for adjustment. It is rather inconvenient in use.

Furthermore, though the spring enables the gear at the other end of the sliding part to engage with the rack of the left member, the spring can only keep the gear in place where the gear can engage with the rack, but the spring cannot ensure a reliable engagement between the gear and the rack. In use, the gear slips from the rack easily, which leads to the failure of the adjustment of the jaw span. In addition, there are so many parts in the configuration which makes the configuration complex.

SUMMARY OF THE INVENTION

The objective of the invention is to provide pliers with adjustable jaw span, which is more convenient to operate, and do not have to operate a button for the adjustment in a direction.

Another objective of the invention is to provide pliers with adjustable jaw span, which enables the positioning and fitting of two members to be more stable and reliable.

A further objective of the invention is to provide pliers with adjustable jaw span, which is simple in structure.

To achieve the above objects, the invention provides pliers with adjustable jaw span, comprising a first member and a second member which cooperate with each other, a long slot is formed in the first member, and the second member is connected with the first member by means of a pivot passing through the long slot and rotatable around the pivot relative to the first member, the span of the jaws is adjustable by varying the position of the pivot in the long slot, wherein the edge of the long slot is provided with a number of ratchet teeth, and the pivot is engaged with the ratchet teeth by a pawl, thus the pivot is movable in a first direction, and immovable in a second direction which is opposite to the first direction within the long slot.

In the invention, the adjustment of jaw span is achieved by the structure in which the ratchet teeth and the pawl cooperate with each other. Since the mating of the ratchet teeth and the pawl is unidirectional, when the jaw span is adjusted it can be randomly adjusted in a direction, and it requires the user's operation only when it is adjusted in the other direction. In the actual operation, the jaw span can be adjusted to the maximum first, then the jaw of the first member is placed to the object, and then the second member is pushed towards the first direction, so that it can be adjusted to the optimal jaw span, without the user's operation for the disengagement of the ratchet teeth and the pawl. Therefore, the convenience and efficiency of the operation are greatly improved.

Preferably, the pawl can be disengaged from the ratchet teeth by an external force, so that the pivot can move in the second direction within the long slot. The pawl can axially move along the pivot so as to be disengaged from the ratchet teeth. Preferably, the external force can be achieved by pressing one end of the pivot so as to drive the pawl to axially move along the pivot.

In the alternative schemes, the pawl can circumferentially move along the pivot or move in the direction vertical to the pivot so as to be disengaged from the ratchet teeth.

Preferably, the pliers further include a return spring, which enables the pawl to automatically return to the state in which the pawl is engaged with the ratchet teeth after the external force is eliminated. Therefore, the return spring can keep the pawl in the position in which the pawl can be engaged with the racket.

Preferably, the pliers further include an offset spring, which can apply a torque force to the pawl so as to keep a stable engagement between the pawl and the ratchet teeth. Therefore, the offset spring can keep the pawl in a mating state in which the pawl is actually engaged with the ratchet teeth by the elastic force of the spring, so as to prevent the pawl from slipping from the ratchet teeth unexpectedly and ensure the efficient adjustment of the jaw span.

Preferably, the return spring and the offset spring are provided by a single coil spring. Preferably, the diameter of the coil spring reduces from one end to the other end gradually so as to form a disc shape when compressed by a force, which saves space, reduces the volume of the products, and facilitates its working in the small or narrow space. Preferably, the pivot is a shaft with different diameters, and the coil spring is installed on the shaft section with a smaller diameter in the shaft with different diameters.

Preferably, the pawl is integrated with the pivot, with a simple structure.

In a specific application, the pliers are a water pump pliers.

Other features and advantages of the invention can be fully understood through the detailed description of the embodiments of the invention with reference to the accompanying drawings hereinafter, in which:

BRIEF DESCRIPTION OF THE DRAWINGS

FIGS. 6 and 7 are schematic views of the spring in the embodiments of the invention, in which FIG. 7 is a top view of FIG. 6;

FIGS. 8 and 9 are schematic views of the pivot assembly in the embodiments of the invention, in which FIG. 9 is a left view of FIG. 8;

FIGS. 10 and 11 are schematic views of the main body of the second member in the embodiments of the invention, in which FIG. 10 is in the same state as the second member shown in FIG. 2, and FIG. 11 is a rear view of FIG. 10;

FIGS. 12 and 13 are schematic views of the first member in the embodiments of the invention, in which FIG. 12 is in the same state as the first member shown in FIG. 2, and FIG. 13 is a rear view of FIG. 12;

Figure 1:
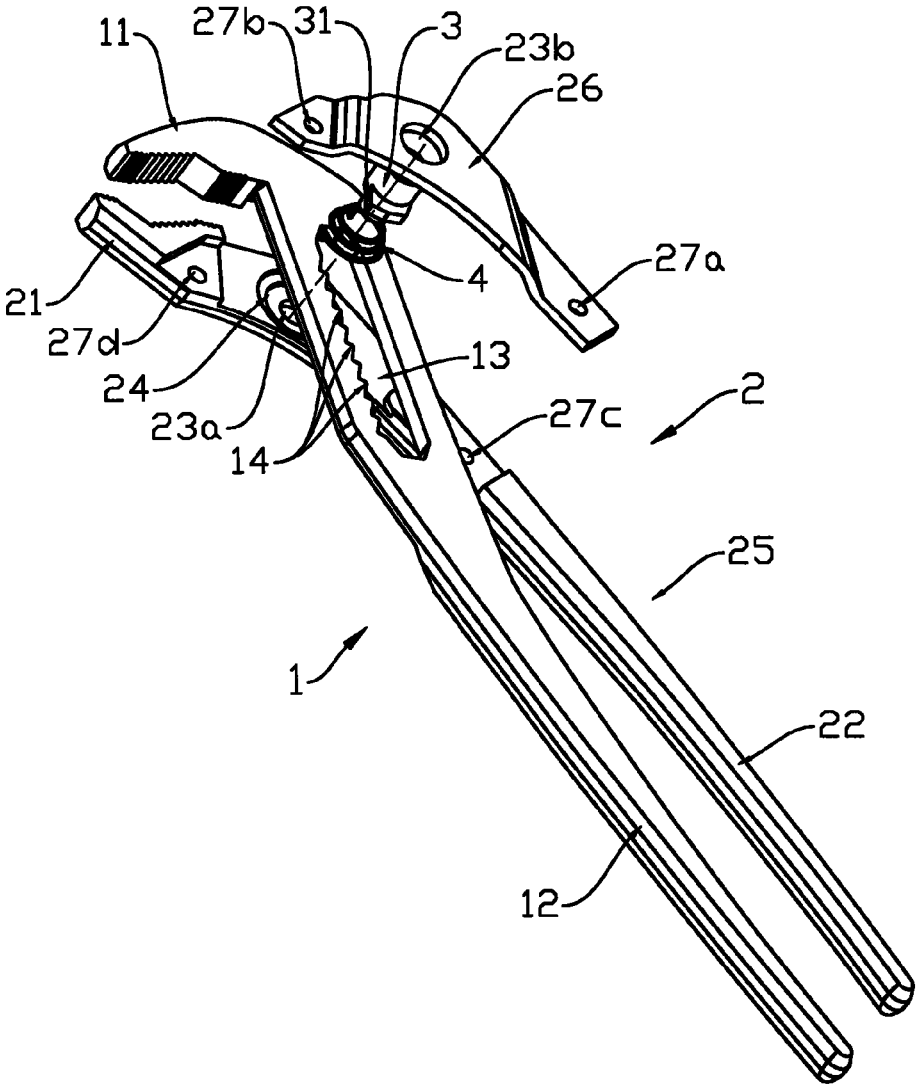
FIG. 1 shows an assembly relationship graph of an embodiment of the pliers according to the invention, and the pliers are a water pump pliers in the embodiment.

The reference numbers in the drawings are as follows: 1—a first member, 11—jaw, 12—handle, 13—long slot, 14—ratchet teeth; 2—a second member, 21—jaw, 22—handle, 23*a*, 23*b*—pivot holes, 24—recess, 25—main body, 26—cover plate, 27*a*, 27*b*, 27*c*, 27*d*—rivet holes, 28—mounting hole; 3—pivot member, 31—pawl, 32—mounting hole; 14—spring, D1—the diameter of the larger end of the spring, D2—the diameter of the smaller end of the spring; 51, 52—abutted surface; 6—jaw.

DETAILED DESCRIPTION OF THE INVENTION

The embodiments of the invention are further described with reference to the accompanying drawings of the specification so as to better understand the invention. In the shown embodiments, the pliers are a water pump pliers. As a matter of course, the invention can also be pliers of other types.

Figure 10:
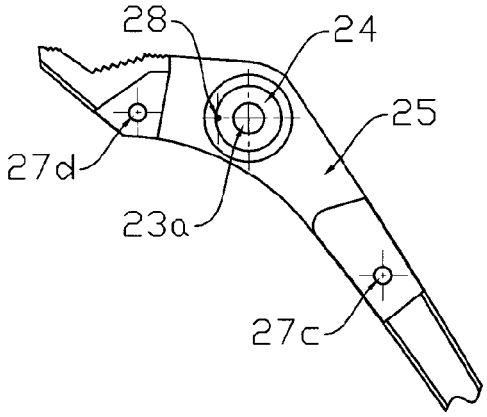
Figure 11:
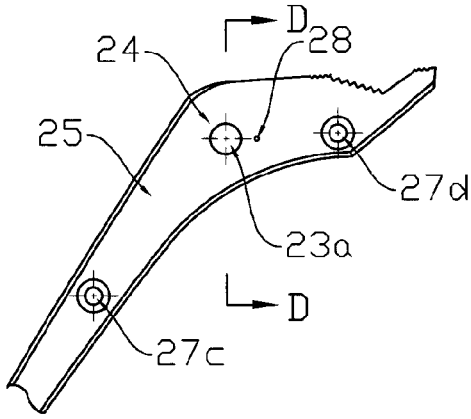
Figure 12:
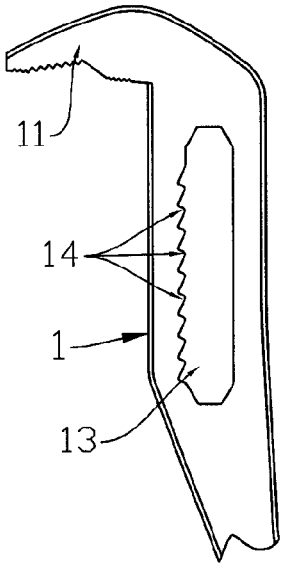
Figure 13:
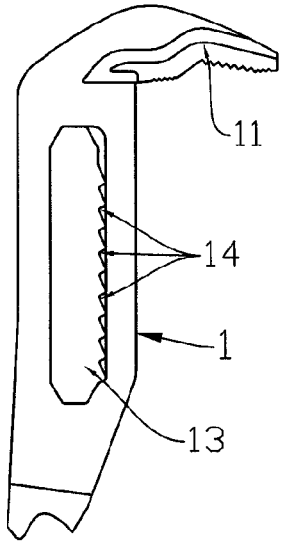

As shown in FIG. 1, the water pump pliers with adjustable jaw span according to the embodiments of the invention includes a first member 1 (referring to FIG. 12 and FIG. 13) and a second member 2 (referring to FIG. 10 and FIG. 11). The second member 2 can rotate by means of a pivot 3 relative to the first member 1, so as to open and close the jaws. The first member 1 is provided with a long slot 13 in an open way. The edge of the long slot 13 is provided with ratchet teeth. The pivot 3 passes through the long slot 13. The second member 2 is connected with the first member 1 by means of the pivot 3.

Figure 8:
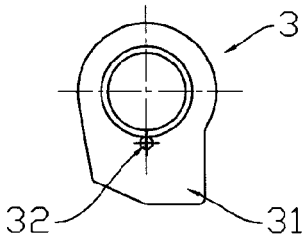
Figure 9:
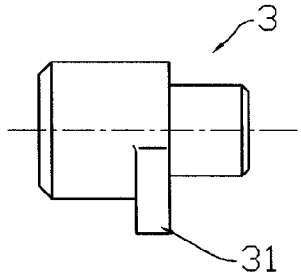
Figure 14:
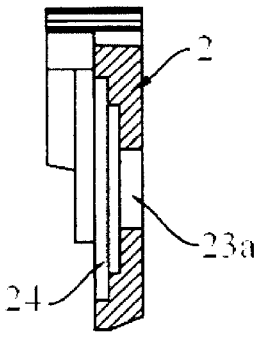
FIG. 14 show a cross-sectional enlarged view along D-D direction in FIG. 11.

In the shown embodiments, the second member 2 is provided with two pivot holes 23*a*, 23*b* located at both sides of the long slot 13, respectively. The pivot holes 23*a*, 23*b* are used for installing the pivot 3. The pivot 3 (referring to FIG. 8 and FIG. 9) is in an integral structure, both ends of which are located movably along the pivot within the two pivot holes 23*a*, 23*b*, respectively, and the middle part of which is provided with a pawl 31 corresponding to the ratchet teeth 14. The radial size (the radial size being the maximal size in the radial direction) of the pawl 31 is larger than the pivot holes 23*a*, 23*b*. The second member 2 is provided with a recess 24 (referring to FIG. 10, FIG. 11 and FIG. 14), with the size being capable of receiving the pawl 31, which provides the movement space for the axial movement of the pivot 3.

The pivot 3 which is integrated with the pawl 31 has a simple structure, which can move axially so as to adjust the span of the jaws 6, while acting as a conventional pivot. Since the mating of the ratchet teeth 14 and the pawl 31 is unidirectional, it can be adjusted randomly in one direction without being obstructed when the jaws is adjusted, without requiring that the pawl 31 is disengaged from the ratchet teeth 14; while it is adjusted in the other direction, the user's operation is required so that the pawl 31 is disengaged from the ratchet teeth 14. Therefore, it is convenient for users to operate.

Furthermore, while the pawl 31 mates with the ratchet teeth 14, since the radial size of the pawl 31 is larger than the pivot holes 23*a*, 23*b*, the pawl can be limited between the two pivot holes 23*a*, 23*b* so as to prevent the pivot 3 from falling off, thereby ensuring that the pivot 3 is assembled with the first member 1 and the second member 2.

A coil spring 4 (referring to FIG. 6 and FIG. 7) is sleeved on the pivot 3, both ends of which are connected to the second member 2 and the pivot 3, respectively. On the one hand, the spring 4 acts as a return spring and provides an axial restoring force (referring to restoring pressure in the embodiment) so that the pawl 31 is located in the position where the pawl 31 is engaged with the ratchet teeth 14, and the pawl leaves the position only when it is subjected to the external force in the axial direction of the pivot so as to be disengaged from the ratchet teeth 14. On the other hand, the coil spring 4 acts as an offset spring, provides a torque force in the circumferential direction of the pivot, and stably keeps the pawl 31 in a state in which the pawl is engaged with the ratchet teeth 14, thereby preventing the pawl 31 from falling off from the ratchet teeth 14 unexpectedly.

Figure 6:
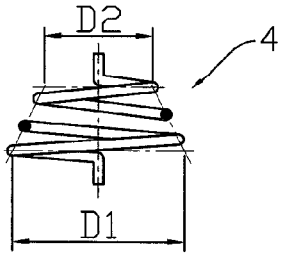
Figure 7:
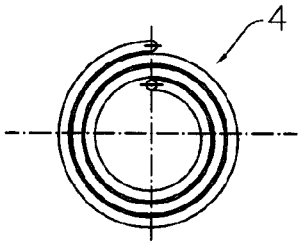

In the shown embodiments, the diameter of the spring reduces gradually from D1 at one end to D2 at the other end (referring to FIG. 6). Seeing laterally, the profile of the spring has an isosceles trapezoid shape so that it has a disc shape while compressed, thus the height of the spring can be greatly reduced (which can be reduced to be as large as the diameter of the spring steel wire), thereby saving the installing space and enabling the structure to be compact.

The spring 4 in the shown embodiments is a single coil spring, which acts both as a return spring and an offset spring. It has a simple structure and simplifies the assembly relationship. It will be appreciated that the return spring and the offset spring can be two individual spring members in other embodiments.

In the shown embodiments of the invention, the pivot 3 (referring to FIG. 8 and FIG. 9) is a shaft with different diameters, including a shaft section with a larger diameter and a shaft section with a smaller diameter, thereby forming an axial step, which helps the positioning of the pawl 31 and limits the pivot 3 between the two pivot holes 23*a*, 23*b* so as to prevent it from falling off. The spring 4 is installed around the shaft section with the smaller diameter.

For facilitating the assembly, the second member 2 includes a main body 25 and a cover plate 26, both of which are fixedly connected together in riveting or welding and other ways. The two pivot holes 23*a*, 23*b* are located in the main body 25 and the cover plate 26, respectively. Furthermore, the main body 25 and the cover plate 26 are abutted with the first member 1 on the plane vertical to the axis of the pivot 3. Such abutting results in abutted surfaces 51, 52 between the main body 25 and the cover plate 26 and the first member 1, respectively, thereby avoiding the relative shaking of the first member 1 and the second member 2 so that they can fit each other accurately.

At least one end of the pivot 3 protrudes out of the pivot holes 23*a* or 23*b* so as to facilitate the pressing operation. After the pivot 3 is pressed, the pivot resists the restoring pressure of the spring 4 and axially moves so as to drive the pawl 31 to axially move, thus the pawl is disengaged from the ratchet teeth 14 and is received in the movement space provided by the recess 24. Upon the pawl 31 is disengaged from the ratchet teeth 14, the pivot 3 can move freely along the long slot 13 so that the second member 2 can move freely relative to the first member 1.

The assembly process of the water pump pliers of the embodiment is described hereinafter. As shown in FIG. 1, the first member 1 is placed onto the main body 25 of the second member 2 with the long slot 13 corresponding to the pivot hole 23*a* in the main body 25 of the second member. And then, both ends of the spring 4 are installed on the main body 25 of the second member and the pivot 3 as required, respectively (as shown in the drawings, the main body of the second member 2 and the pivot 3 are provided with installing holes 28, 32, respectively). The pawl 31 is made to be engaged with the ratchet teeth 14. And then, the cover plate 26 is overlapped on the main body 25 of the second member 2 so that the main body 25 of the second member 2 and the cover plate 26 retain the first member 1 therebetween. And then, the cover plate 26 is fixed on the main body 25 of the second member 2 in a fixed connection (such as riveting, welding and so on), and the assembly is completed, referring to FIG. 2 to FIG. 5, and FIG. 15.

According to the embodiment, in the natural state, both the bias force and the restoring force of the spring 4 keep the pawl 31 in place where the pawl is engaged with the ratchet teeth 14. Namely, the restoring force of the spring 4 keeps the pawl 31 in place where the pawl is capable of being engaged with the ratchet teeth 14 (referring to FIG. 3), while the bias torque of the spring 4 keeps the pawl 31 in a stable mating state in which the pawl is actually engaged with the ratchet teeth 14 (referring to FIG. 5).

Figure 2:
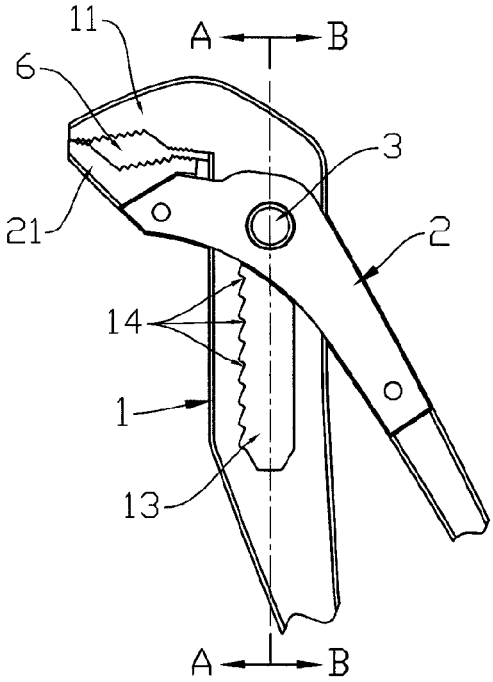
FIG. 2 is a schematic view showing that the jaws of the water pump pliers in the embodiments of the invention is in a closed state.
Figure 3:
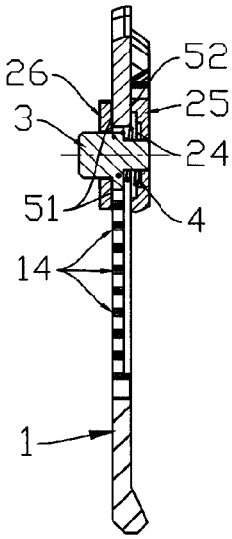
FIG. 3 is a cross-sectional view along A-A direction in FIG. 2.
Figure 4:
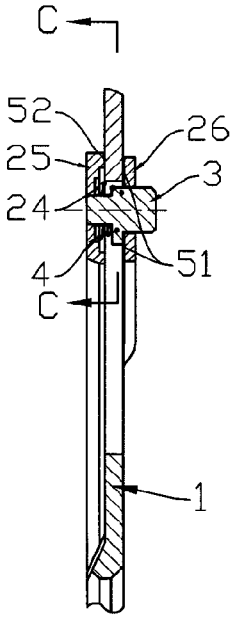
FIG. 4 is a cross-sectional view along B-B direction in FIG. 3.
Figure 5:
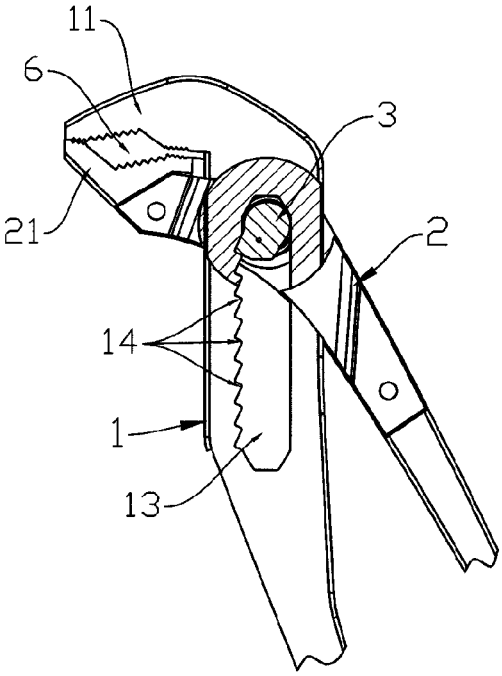
FIG. 5 is a cross-sectional view along C-C direction in FIG. 4.
Figure 15:
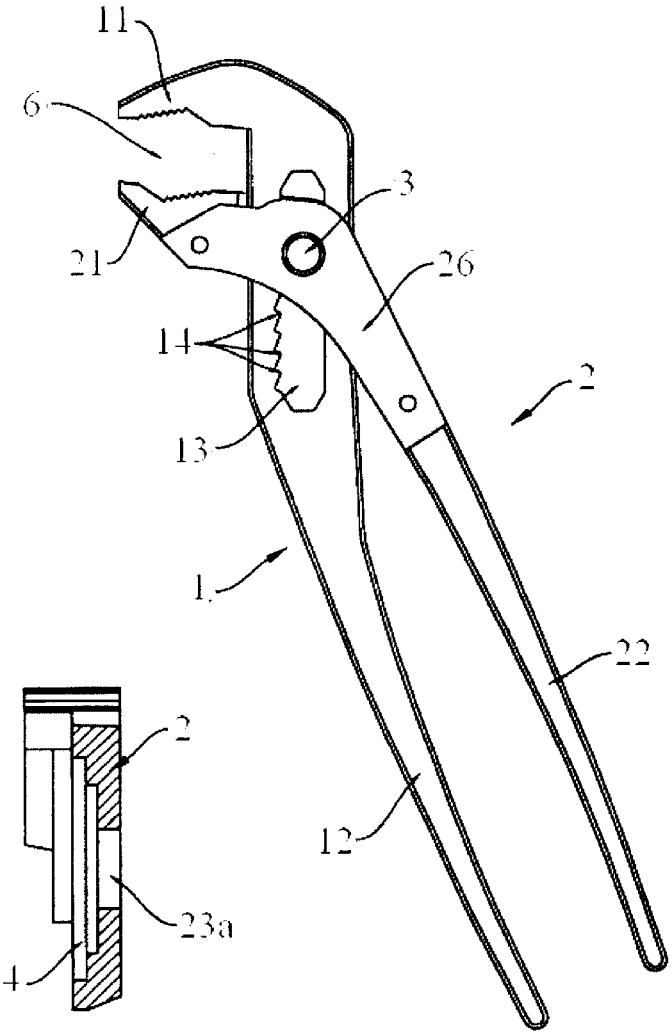
FIG. 15 is a schematic view showing that the jaws of the water pump pliers in the embodiments of the invention is in an open state.
Figure 16:
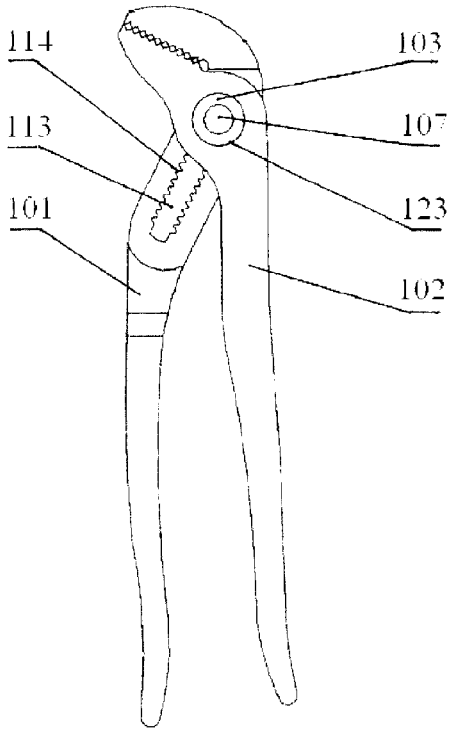
Fig. 16 (Prior Art)
FIG. 16 is a structural schematic view of a water pump pliers in the prior art.
Figure 17:
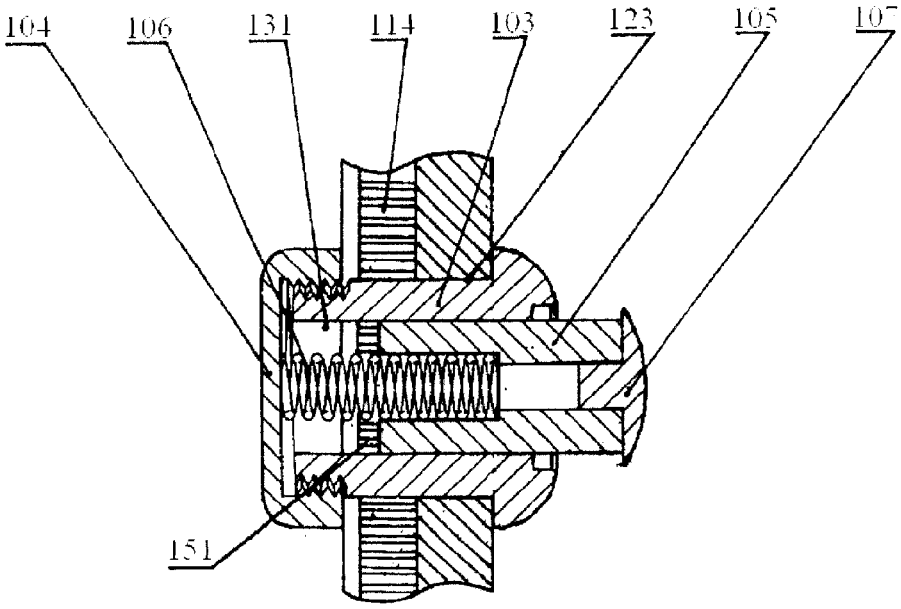
Fig. 17 (Prior Art)
FIG. 17 is a cross-sectional structural schematic view of the pivot part of the water pump pliers in FIG. 16.

When the span of the jaws 6 is adjusted, if the span of the jaws is adjusted to be larger (being adjusted from the state as shown in FIG. 2 to the state as shown in FIG. 15), it is required that the pivot 3 is pressed axially (pressing towards the right, as shown in FIG. 3), the pressure of the spring 4 is overcome so that the pawl 31 is disengaged from the ratchet teeth 14, then the second member 2 is slid downwardly relative to the first member 1 to complete the adjustment. After it is adjusted in place, the pivot 3 is released from pressing, and the pivot 3 resets to the state in which the pawl 31 and the ratchet teeth 14 are engaged under the effect of the spring 4. At this moment, the pipe fittings and other work pieces can be clamped with the jaws 6. If the jaws is adjusted to be smaller (being adjusted from the state as shown in FIG. 15 to the state as shown in FIG. 2), it is not required that the pivot 3 is pressed axially, instead, the second member 2 is slid upwardly relative to the first member 1 directly, and the adjustment is achieved. During the adjusting process, the pawl 31 slides up and over the ratchet teeth 14 one by one, and makes a sound of click . . . click . . . click. After it is adjusted in place, the pawl 31 is engaged with the ratchet teeth 14. As a matter of course, when the jaw span is adjusted to be smaller, the pivot 3 can also be pressed axially (pressing towards the right, as shown in FIG. 3), the pressure of the spring 4 is overcome so that the pawl 31 is disengaged from the ratchet teeth 14, then the second member 2 is slid upwardly relative to the first member 1, to complete the adjustment.

In the actual use, the jaw span is adjusted to the maximum first, then the jaw 11 of the first member 1 is placed on the object to be clamped, the handle 22 of the second member 2 is pushed directly, and an unidirectional and rapid adjustment can be carried out. It can be adjusted into the optimal position with a single attempt, which saves time and facilitates operation.

The preferable embodiments of the invention are described in detail with reference to the accompanying drawings previously. It should be appreciated that the skilled in the art can conceive many flexible embodiments without departing from the spirit of the invention.

For example, though in the shown embodiments, the pawl 31 is driven to axially move along the pivot by pressing the pivot 3 so that the pawl is disengaged from the ratchet teeth 14, in other alternative manners, it is also contemplated that the pawl 31 circumferentially rotates along the pivot or moves in the plane vertical to the axis of the pivot 3 so that the pawl is disengaged from the ratchet teeth 14.

Although in the shown embodiments, there is only one pawl 31, it can be appreciated that there can be a plurality of pawls 31, which are circumferentially arranged on the pivot 3. A plurality of pawls 31 are provided, which can mate with several ratchet teeth 14 at the same time, transferring a greater force and strengthening the stability of the engagement. Furthermore, if one tooth of the ratchet teeth 14 is damaged, it can still be used continuously. In addition, in the installing process, it is unnecessary to pay special attention to the circumferential position of the pivot 3. It is only required that the pawl 31 should be capable of mating with the ratchet teeth 14.

Therefore, the scope of protection of the invention should be based on the appended claims hereinafter.

The invention claimed is:

1. Pliers with adjustable jaw span, comprising a first member and a second member which cooperate with each other, a long slot is formed in the first member, and the second member is connected with the first member by means of a pivot passing through the long slot and rotatable around the pivot relative to the first member, the span of the jaws is adjustable by varying the position of the pivot in the long slot, wherein the edge of the long slot is provided with a number of ratchet teeth, and the pivot is engaged with the ratchet teeth by a pawl, thus the pivot is movable in a first direction and immovable in a second direction which is opposite to the first direction within the long slot, wherein the pawl is disengaged from the ratchet teeth by an external force, so that the pivot is movable in the second direction within the long slot, wherein the pliers further comprises a return spring, which enables the pawl to automatically return to the state in which the pawl is engaged with the ratchet teeth after the external force is eliminated, wherein the pliers further comprises an offset spring, which applies a torque force to the pawl so as to keep a stable engagement between the pawl and the ratchet teeth, wherein the return spring and the offset spring are provided by a single coil spring.

2. The pliers according to claim 1, wherein the pawl is axially movable along the pivot by the external force so as to be disengaged from the ratchet teeth.

3. The pliers according to claim 1, wherein the external force is provided by pressing one end of the pivot so as to drive the pawl to axially move along the pivot.

4. The pliers according to claim 1, wherein the second member is provided with a recess so as to receive the pawl in the recess after the pawl axially moves along the pivot and is disengaged from the ratchet teeth.

5. The pliers according to claim 1, wherein the pawl is circumferentially rotated along the pivot by the external force so as to be disengaged from the ratchet teeth.

6. The pliers according to claim 1, wherein the pawl moves in the direction vertical to the pivot by the external force so as to be disengaged from the ratchet teeth.

7. The pliers according to claim 1, wherein the pivot is a shaft with different diameters, which comprises a shaft section with a larger diameter and a shaft section with a smaller diameter, and the coil spring is sleeved on the shaft section with the smaller diameter.

8. The pliers according to claim 7, wherein one end of the coil spring is fixed on the pivot, while the other end is fixed on the one of the members which is rotatable around the pivot.

9. The pliers according to claim 1, wherein the diameter of the coil spring reduces from one end to the other end gradually so as to form a disc shape while compressed by a force.

10. The pliers according to claim 1, wherein the pawl is integrated with the pivot.

11. The pliers according to claim 1, wherein there are a plurality of pawls.

12. The pliers according to claim 11, wherein the pawl is arranged on the pivot along the circumferential direction of the pivot.

13. The pliers according to claim 1, wherein the second member comprises a main body and a cover plate detachably fixed to the main body, and the pivot is fixed to the second member via two pivot holes located in the main body and the cover plate, respectively.

14. The pliers according to claim 13, wherein one end of the pivot protrudes out of the pivot holes of this end.

15. The pliers according to claim 1, wherein the pliers are water pump pliers.

* * * * *